United States Patent [19]

Sheng

[11] Patent Number: 5,035,665

[45] Date of Patent: Jul. 30, 1991

[54] APPARATUS FOR MAKING BUBBLES IN MULTIPLE LAYERS

[76] Inventor: Lin M. Sheng, No. 195, Chieng-Kou Road, Hsintien City, Taipei Hsien, Taiwan

[21] Appl. No.: 506,346

[22] Filed: Apr. 9, 1990

[51] Int. Cl.[5] ..... A63H 33/28

[52] U.S. Cl. ..... 446/15; D21/61

[58] Field of Search ..... 446/15, 19, 20, 21; D21/61

[56] References Cited

U.S. PATENT DOCUMENTS

| | | | |
|---|---|---|---|
| 2,213,391 | 9/1940 | Gamble | 446/19 |
| 2,527,935 | 10/1950 | Joel, II | 446/15 |
| 3,295,248 | 1/1967 | Knerr et al. | 446/15 |
| 4,467,552 | 8/1984 | Jernigan | 446/15 |

*Primary Examiner*—Mickey Yu

*Attorney, Agent, or Firm*—Bacon & Thomas

[57] ABSTRACT

A plurality of co-planar, concentric ribbon-like rings are provided and rigidly interconnected. A handle projects radially outwardly of and is supported from a predetermined periphery of the largest ring and the handle is blade-like in configuration and disposed in a plane substantially paralleling the plane of the rings. The concentric, co-planar relation of the rings and the provision of a blade-type handle disposed in a plane paralleling the plane of the rings co-act to provide a bubble blowing apparatus which promotes usage thereof even by small children in a manner to reduce possibility of accidental injury to adjacent.

8 Claims, 2 Drawing Sheets

APPARATUS FOR MAKING BUBBLES IN MULTIPLE LAYERS

BACKGROUND OF THE INVENTION

This invention relates to an apparatus for making bubbles in multiple layers and more specifically to an apparatus to be hand held by a child user and moved rapidly through the air after being coated with a low surface tension bubble forming liquid. The apparatus has been specifically designed for maximum safety in use by a small child, even when other children may be in close proximity.

Various different forms of apparatuses for making bubbles within bubbles heretofore have been provided, such as disclosed in U.S. Pat. Nos. 430,095, 2,527,935, 3,323,250, and 3,402,502 as well as Great Britian Patent No. 1,329,796.

The bubble blowing devices disclosed in U.S. Pat. No. 430,095, 3,323,250 and 3,402,502 each comprise an elongated structure having one end from which bubbles within bubbles are to blown and an opposite end to be placed against the mouth of the user for the purpose of enabling the user to blow into that end.

This type of toy for children presents several problem areas encountered during usage thereof which may result in injury to a small child. First of all, these bubble devices are to operated by a person blowing into one end of an elongated structure and therefore require placement of the devices at least in close proximity to the mouth of the user.

Secondly, in some instances the devices are designed to have one end thereof placed in the mouth of the user and a small child, preparatory to blowing into the end of the toy in his mouth, may first inhale through the device and thus ingest any low surface tension liquid which may be thereon.

Thirdly, a child taught to hold one end of an elongated device in his mouth for proper use of the toy often will run from one location to another with the one end of the device in his mouth.

Further, although U.S. Pat. No. 2,527,935 and Great Britain Patent No. 1,329,796 do not disclose elongated devices adapted to have air blown into one end thereof, they do disclose hand held ring-type structures which incorporate certain features that also may be contributory to accidental injury either to the user or an adjacent child.

SUMMARY OF THE INVENTION

The apparatus of the instant invention has been designed to enable small children to make bubbles within bubbles and the apparatus further has been designed to enable its usage by small children in a relatively safe manner.

The apparatus does not comprise an elongated tubular member adapted to have air blow into one end thereof from the user's mouth, but instead comprises a hand held apparatus which is relatively flat and includes rounded edges which face in substantially all directions in the plane in which the apparatus is disposed. Furthermore, the hand apparatus includes a laterally directed handle to be grasped by the hand of the user and the handle is flat and generally blade-shaped in configuration with all normally exposed surfaces thereof rounded or flat. In addition the plane of the blade-like handle is disposed in the plane of the flat apparatus and, accordingly, a person, such as a small child, holding the handle of the apparatus tends to hold the handle in a manner such that back and forth arm movements will move the flat apparatus in directions disposed generally normal to the plane of the apparatus to thus substantially reduce the possibility of injury to an adjacent child by a child using the apparatus to produce bubble within bubbles.

Another object of this invention, in accordance with the immediately preceding object, is to provide an apparatus constructed in a manner such that usage of the apparatus by a small children may be carried out with little danger of accidental injury to other children in close proximity to the user.

Yet another important object of this invention is to provide an apparatus designed to be used in a manner which will not promote a small child to carry the apparatus from one location to another so as to cause serious injury to the child should he or she trip and fall.

Still another object of this invention is to provide a bubble blowing apparatus incorporating a handle of specific shape designed to promote the gripping of the handle by a child user in a manner such that normal arm movements will operate the apparatus so as to minimize any possible injury should an adjacent child be struck during use of the apparatus by a child.

A final object of this invention to be specifically enumerated herein is to provide an apparatus in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
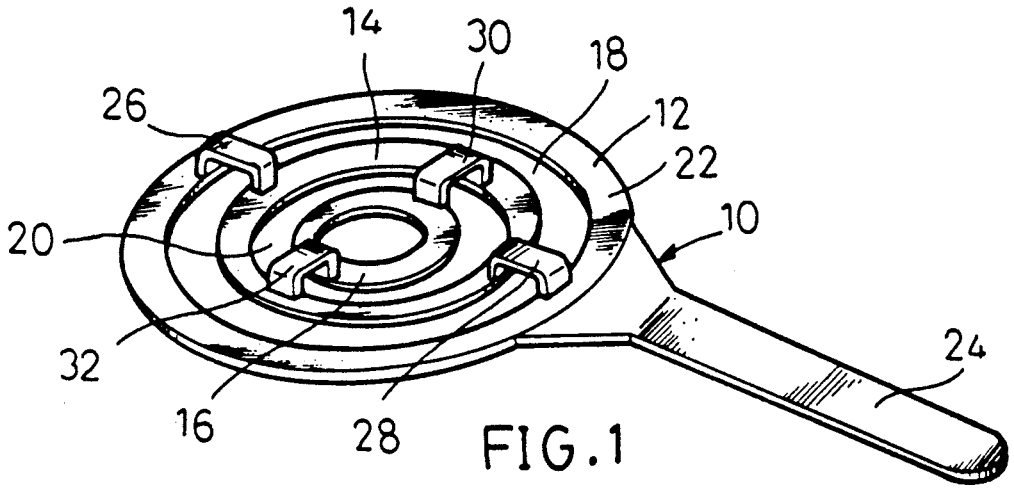
FIG. 1 is a perspective view of a first embodiment of a multiple bubble blowing apparatus constructed in accordance with the present invention incorporating three concentric co-planar rings.

Referring now more specifically to FIG. 1, the numeral 10 generally designates a first embodiment of a bubble blowing apparatus constructed in accordance with the present invention.

The apparatus 10 includes first, second, and third large, intermediate and small diameter ribbon-like rings 12, 14 and 16, respectively constructed of shape retentive material and disposed in co-planar, concentric relation, with the inside diameters of the large and intermediate size rings greater than the outside diameters of the intermediate and small rings 14 and 16, respectively. In this manner, annular spaces 18 and 20 are defined between the intermediate size ring 14 and the large size ring 12 and between the small ring 16 and the intermediate size ring 14, respectively.

The rings are of greater radial extent than axial extent and one peripheral portion 22 of the ring 12 includes a generally radially outwardly directed, integral, blade-type handle 24 which is also co-planar with the rings 12, 14 and 16, the transverse width of the handle 12 being appreciably greater than the thickness thereof.

The ring 14 is supported from the ring 12 through the utilization a first pair of U-shaped bridging members 26 and 28 extending between and interconnecting the rings 12 and 14 along a diameter of the ring 12 also containing the handle 24, and a second pair of U-shaped bridging members 30 and 32 extend between and interconnecting the rings 14 and 16 along a diameter of the ring 12 disposed at generally right angles to the diameter of the right 12 along which the members 26 and 28 extend.

Figure 2:
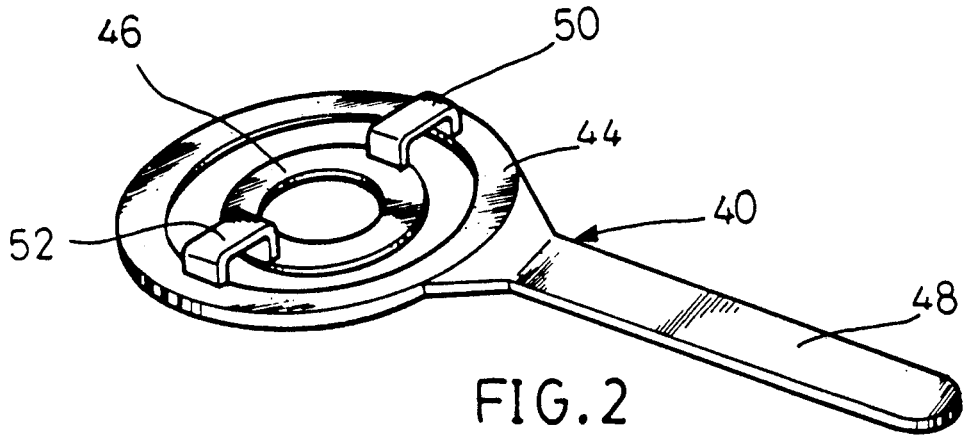
FIG. 2 is a perspective view similar to FIG. 1 but illustrating a second slightly modified embodiment of the invention including only two concentric co-planar rings.

With attention now the FIG. 2 of the drawings, a second embodiment in accordance with the present invention is referred to in general by the reference numeral 40. The apparatus 40 is substantially identical to the apparatus 10, except that the apparatus 40 includes only two rings 44 and 46 corresponding to the rings 14 and 16 and a handle 48 corresponding to the handle 24 which is formed integrally with the ring 44, the rings 44 and 46 being joined by a pair of U-shaped bridging members 50 and 52 corresponding to the bridging members 30 and 32.

Figure 3:
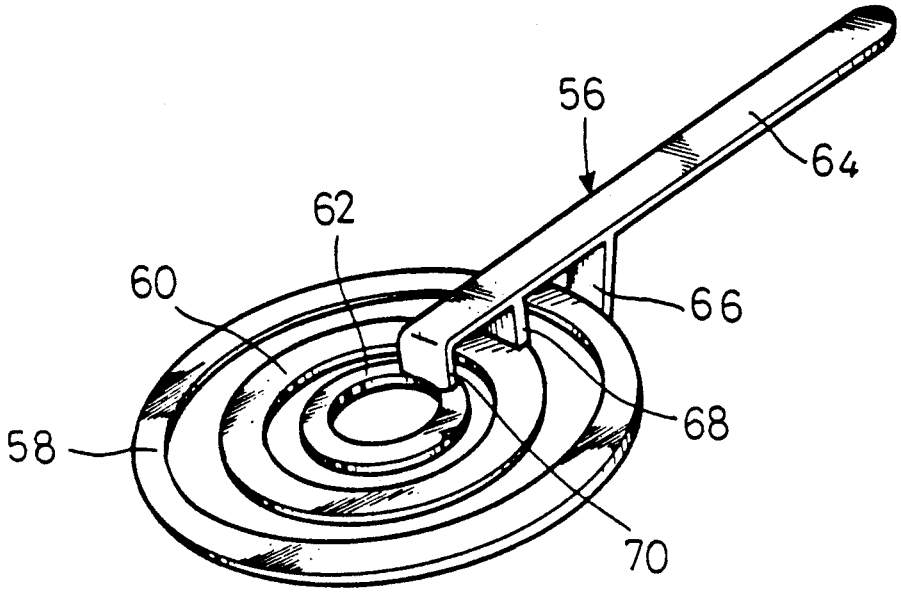
FIG. 3 is a third embodiment perspective view of a modified of the invention utilizing three concentric co-planar rings, but provided with a laterally offset blade-type handle.

With reference now to FIG. 3, a third embodiment of the present invention is referred to in general by the reference numeral 56. The apparatus 56 includes large, intermediate and small diameter rings 58, 60, respectively, and 62 which are co-planar and concentric and a blade-type handle 64 disposed in a plane laterally spaced from the plane of the rings 58, 60 and 62 and with integral laterally directed portions 66, 68 and 70 being provided to join the handle 64 to the rings 50, 60 and 62. Although the rings 58, 60 and 62 include only one point of support relative to each other and the handle 64, it has been found that certain plastic materials may be utilized in the construction of the apparatus 56 in order to provide ample support of the rings 58, 60 and 62 relative to each other and from the handle 64.

Figure 4:
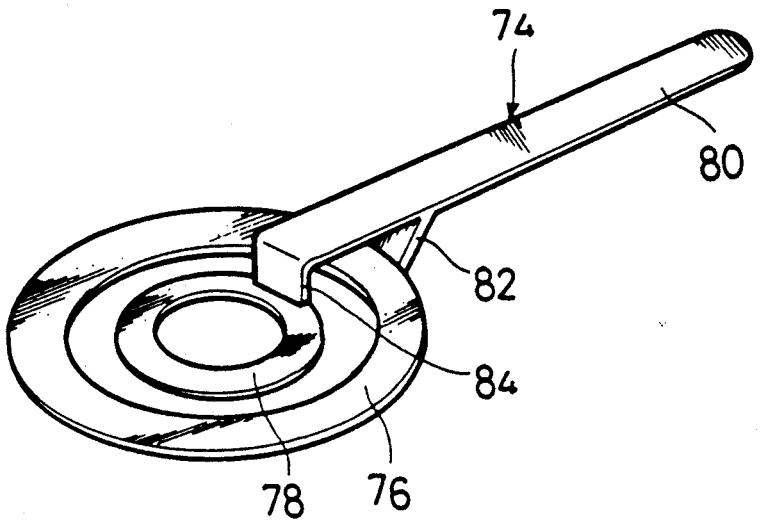
FIG. 4 is a perspective view similar to FIG. 3 but illustrating a fourth embodiment of the invention including only two concentric co-planar bubble blowing rings.

With reference now more specifically to FIG. 4, a fourth embodiment of the present invention is referred to in general by the reference numeral 74. The apparatus 74 includes only two concentric and co-planar rings 76 and 78, and a handle 80 corresponding to the handle 80. However, the handle 64 includes only two laterally directed portions 82 and 84 which extend between the handle 80 and rings 76 and 78 to support the rings 76 and 78 from each other and the handle 80.

In all disclosed embodiments of the invention, the multiple rings thereof are concentric and substantially coplanar and each apparatus includes a blade-type handle which extends generally radially outwardly therefrom and is disposed in a plane coinciding with the plane of the corresponding rings, or disposed in a plane which parallels the plane of the corresponding rings.

By this type of construction the smaller rings 14, 16, 46, 60, 62 and 78 all are contained within and co-planar with a larger ring. Thus, even the arcuate outer peripheries of the smaller rings 14, 16, 46, 62, 60 and 78 are shielded by the corresponding larger rings against contact with another person or pet in the event the corresponding apparatus is being held by its blade-type handle and moved rapidly through the air by the user thereof and the held apparatus should contact an adjacent person or pet.

Furthermore, by having the plane of each bladetype handle disposed in a plane paralleling or coinciding with the plane of the corresponding rings, the most natural way of a child to grasp the handle in his hand is with the plane of the handle generally paralleling the plane of hand from which the handle is being held. When thus held, normal arm movement to move either apparatus through the air at sufficient speed to "blow" bubbles therefrom will result in the apparatus being moved in a direction normal to the plane of its rings and handle.

Of course, any toy may be misused by a child, but after having once demonstrated to a child the proper way to effect movement of the rings through the air in directions disposed generally normal to the planes of the rings, there is less tendency for a child to misuse the apparatus by movement thereof in an incorrect direction since as the apparatus will not then produce bubbles.

Figure 5:
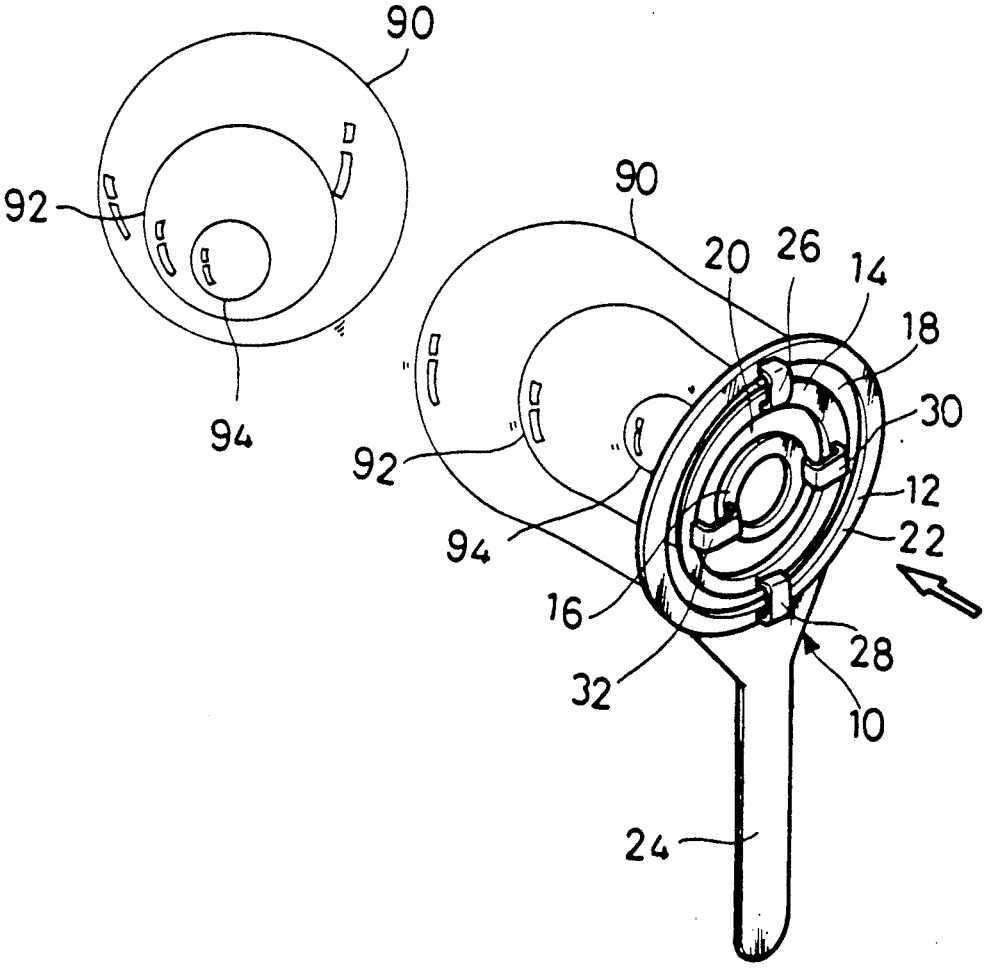
FIG. 5 is a perspective view drawing of the embodiment shown in FIG. 1, illustrating the operation of the multiple bubble blowing apparatus wherein two bubbles are formed within the largest bubble and the smallest bubble being disposed within the intermediate size bubble.

In operation, the apparatus 10, 40, 56 or 74 is gripped by the hand of the user and manually manipulated to dip the rings of the apparatus into a solution of bubble producing liquid. Then, the rings are lifted out of the bubble producing liquid and the apparatus is moved through the air in a direction at generally a right angle to the plane of the rings and handle thereof. As seen in FIG. 5, by moving the rings 12, 14 and 16 through the air in this manner the air will be forced through the rings and in the case of the apparatus 10 three bubbles 90, 92, 94, will be formed with two bubbles 92, 94 within the largest bubble 90 and the smallest bubble 94 being disposed within the intermediate bubble 92. Of course, this game may be repeated many times and the speed of movement of the rings of the apparatus through the air also determines the sizes of the bubbles to formed by the different size rings.

If either apparatus 40 or 74 is utilized in substantially the same manner, a large bubble and a small bubble will be formed, with the small bubble being within the larger bubble. Here again, the speed of movement of the rings through the air will partially determine the size of the bubbles produced thereby. Further, some bubble producing liquids are capable of being blown into larger bubbles than other bubble producing liquids.

By providing a bubble blowing apparatus which is not elongated and designed to have one end thereof placed against the mouth of the user, by providing a bubble blowing apparatus of the type illustrated and described wherein the rings thereof are co-planar, and by including a blade-type handle on a bubble blowing apparatus of the ring-type described and illustrated with the plane of the handle substantially co-planar with the planes of the rings, a relatively safe bubble blowing apparatus is provided for use by young children. By utilizing a generally paddle-type apparatus which must be moved in a direction disposed generally 90° to the relative to the plane of the paddle-type apparatus, no sharp edges are exposed in the direction of movement in case of accidental contact with a nearby person. The provision of a blade-type handle assures, as much as possible, that even young children will hold the bubble blowing apparatus and move the latter through the air in the correct manner to further reduce the possibility of personal injury, and by providing concentric co-planar rings it is assured that the greater possibility of injury by contact with a smaller ring will not occur, inasmuch as the smaller rings are enclosed within larger rings.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to and falling within the scope of the invention.

I claim:

1. A bubble blowing apparatus comprising:

a) first and second rings, each ring being flat and having a width greater than its thickness, the first ring being of larger diameter than the second ring;

b) the second ring being concentrically disposed within the first ring and in a substantially coplanar relation therewith;

c) means securing the first and second rings together to define an uninterrupted annular spacing therebetween; and d) a flat handle extending outwardly from an outer periphery of the first ring, the handle being disposed in a plane that is substantially parallel with the plane of the rings.

2. The apparatus of claim 1 further including:

a) a third ring having a diameter intermediate the diameters of the first and second rings, the third ring being flat and having a width greater than its thickness;

b) the third ring being concentrically disposed between the first and second rings in a substantially coplanar relation therewith to define two uninterrupted annular spacings therebetween; and c) means securing the third ring to the first and second rings.

3. The apparatus of claim 2 wherein:

a) the plane of the handle is spaced from the plane of the rings and a portion of the handle extends generally radially across the rings; and b) the means securing the rings includes three laterally extending members bridging the radial portion of the handle and the rings.

4. The apparatus of claim 2 wherein the means securing the rings together include:

a) first and second pairs of U-shaped members;

b) the first pair of members bridging the annular spacing between the first and third ring and the second pair of members bridging the annular spacing between the second and third rings; and c) the first and second pairs of U-shaped members being circumferentially spaced around the rings.

5. The apparatus of claim 1 wherein the plane of the handle is substantially coplanar with the rings.

6. The apparatus of claim 1 wherein the plane of the handle is spaced from the plane of the rings.

7. The apparatus of claim 6 wherein:

a) a portion of the handle extends generally radially across the rings; and b) the means securing the rings includes two laterally extending members bridging the radial portion of the handle and the rings.

8. The apparatus of claim 1 wherein the means securing the rings together includes a pair of U-shaped members which bridge the annular spacing between the rings and are circumferentially spaced therearound.

* * * * *